United States Patent [19]

Thur

[11] Patent Number: 4,790,162

[45] Date of Patent: Dec. 13, 1988

[54] DOOR-LOCK MOUNTING PLATE

[76] Inventor: Werner Thur, 56 rue du Fief, 62840 Sailly sur la Lys, France

[21] Appl. No.: 92,894

[22] Filed: Sep. 4, 1987

[30] Foreign Application Priority Data

Feb. 3, 1987 [FR] France ..... 87/01723

[51] Int. Cl.[4] ..... E05B 15/02

[52] U.S. Cl. ..... 70/452; 70/451; 70/462; 292/336.3; 292/357; 292/DIG. 30

[58] Field of Search ..... 70/450–452, 70/455, 462; 292/336.3, 356, 357, DIG. 30, DIG. 31

[56] References Cited

U.S. PATENT DOCUMENTS

| | | | |
|---|---|---|---|
| 1,942,525 | 1/1934 | Weller | 70/452 |
| 2,815,655 | 12/1957 | Boer | 70/451 |
| 3,211,486 | 10/1965 | Crandell | 70/451 X |
| 4,236,396 | 12/1980 | Surko et al. | 70/452 X |
| 4,569,547 | 2/1986 | Fayerman et al. | 292/336.3 X |
| 4,604,879 | 8/1986 | Neary et al. | 70/451 X |
| 4,640,112 | 2/1987 | Kambic | 70/451 X |
| 4,696,174 | 9/1987 | Marks | 70/462 X |

FOREIGN PATENT DOCUMENTS

| | | | |
|---|---|---|---|
| 14724 | of 1905 | United Kingdom | 70/452 |
| 1472070 | 4/1977 | United Kingdom | 70/452 |

*Primary Examiner*—Gary L. Smith
*Assistant Examiner*—Suzanne L. Dino
*Attorney, Agent, or Firm*—Collard, Roe & Galgano

[57] ABSTRACT

This mounting and protection plate for door lock handles is applicable notably as an ornamental fitting to the doors of private houses. The plate (5) comprises a back recess (9) in which a spiral return spring (10) is disposed. The inner turn of the spring has a square configuration engaged by the square-sectioned handle-bar of the door lock which interconnects the handle and the lock mechanism, and the outer turn of the spring is anchored to the plate by engaging a groove formed therein, the spiral spring constantly urging the handle to its normal, inoperative position, independently of the lock spring.

9 Claims, 1 Drawing Sheet

DOOR-LOCK MOUNTING PLATE

BACKGROUND OF THE INVENTION

1. Field of the Invention

This invention relates to a door-lock mounting plate for use notably as an ornamental device in private houses.

The function of door-lock mounting intended for ornamental purposes is well known; they are also effective for protecting painted and other doors against finger marks.

2. The Prior Art

The plate style should in principle match the style of the door handle so as to be in harmony therewith. A hole is formed through the door plate for the square-sectioned handle-bar connecting the handle to the lock mechanism fitted in the door mortise.

Rotating the handle will actuate the bolt which recedes into the lock and thus permits the door opening movement. A door-lock comprises as a rule two springs, a first spring engaging the bolt directly for urging it to its operative or locking position. This spring is actuated alone when the door is slammed, without actuating the handle. Thus, it allows the bolt to recede into the lock simply when it is depressed by an external pressure.

The second spring incorporated in the lock urges the handle-bar to return the handle to its normal or inoperative position when no other external forces are exerted thereon. This second spring permits notably of preventing the handle from rotating when the bolt alone is actuated.

There are two main types of door handles, that is to say, the handles having a perfectly symmetrical configuration, such as the knob or ball type, and those which, in contrast thereto, are unbalanced by the presence of a lateral or overhanging arm.

Symmetrical handles are substantially trouble-free in operation. However, asymmetric handles, which are more widely used, are characterised by construction by a relatively considerable degree of unbalance. Thus, for instance, certain replicas of old-style door handles are made of solid metal, and therefore have an appreciable overhang.

This type of door handle exerts a considerable stress on the lock return spring and therefore after a relatively short time the presence of a heavy asymmetric handle and the excessive torque resulting therefrom are sufficient for preventing the bolt from moving outwardly so that the door cannot close and remain safely locked.

Nowadays the manufacture of locks is greatly standardized and programmed to meet all practical requirements with a relatively light handle. Any excess in this respect is attended by a premature damage of the lock.

SUMMARY OF THE INVENTION

It is the primary object of the present invention to provide a plate for a door handle which can be utilized with all types of handles, notably those having a considerable amount of unbalance, without causing the presence of this plate to have negative consequences on the lock return spring.

The door-lock mounting plate of the present invention relieves the lock return spring and extends considerably its useful life.

It is another object of the present invention to provide a polyvalent door-lock mounting plate. In fact, the door-lock mounting plate of the present invention is applicable indifferently to left-hand and right-hand opening doors. Moreover, this plate can easily be adjusted as a function of the torque to be counterbalanced. The presence of the plate of the present invention does not make it more difficult to actuate the handle and the plate can be fitted without any modification of the door.

On the other hand, the useful life of certain already worn locks can be extended simply by fitting a door-lock plate according to the present invention.

Other objects and advantageous feature of the present invention will appear as the following description of a typical form of embodiment given by way of illustration, not of limitation; proceeds.

According to the instant invention, the door-lock mounting plate adapted to be associated with a lock mechanism for actuating the lock bolt by rotating the handle, this handle being of a type producing a relatively high degree of unbalance, is characterised in that the door plate incorporates means for constantly urging the handle to its normal or inoperative position.

THE DRAWING

FIG. 1 is a perspective view of a door provided with a handle, a mounting plate and a mortise lock, FIG. 2 is an elevational, part-sectional view showing diagrammatically the means for rotatably coupling the handle and the mortise lock, FIG. 3 is an elevational view showing the back face of the door-lock mounting plate according to a preferred form of embodiment of the present invention, and FIG. 4 is a vertical axial section of the door-lock mounting plate of FIG. 3.

DESCRIPTION OF THE PREFERRED EMBODIMENT

The present invention is directed to provide a door-lock mounting plate intended notably for use also as an ornamental element in private houses.

The lock mechanism fitted to doors is conventionally provided with a handle by which a movement of rotation is transmitted to an inner component element of the lock.

In locks of this type the mounting plate constitutes an essential decorative element and also a means for protecting the door against fingermarks. This plate has a handle-bar hole formed through it for receiving the square-sectioned handle-bar operatively connecting the handle to the lock mechanism.

This lock mechanism comprises as a rule two springs, namely a first spring exerting its resilient pressure directly against the bolt so as to urge same to its operative or outward position, and a second spring acting against the handle-bar for constantly urging the handle to its normal or inoperative position.

When the handle is fitted in position the unbalance resulting from its asymmetry exerts a relatively heavy torque on the lock mechanism, thus causing a premature wear and tear of the return spring, until this spring is too weak to return the handle and the lock must be replaced.

Figure 1:
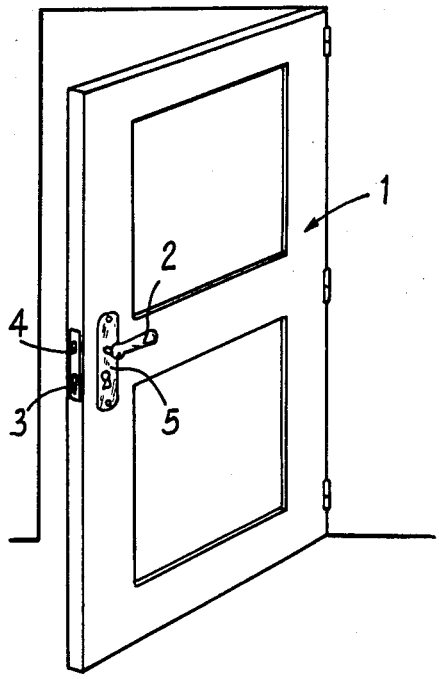

FIG. 1 illustrates a door 1 equipped with a handle 2, a mortise lock 3 incorporated in the door edge and provided with at least one bolt 4.

The mounting plate 5 secured to the door 1 is interposed between the handle 2 and the lock mechanism 3.

Figure 2:
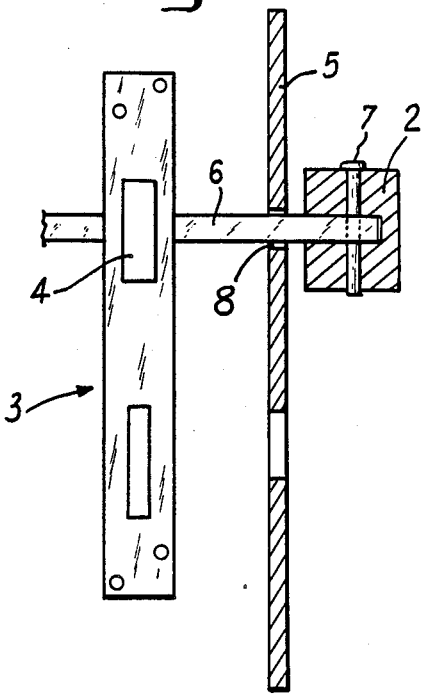

FIG. 2 illustrates in part-elevational, part-sectional view the coupling between the lock mechanism 3 and the control handle 2. This coupling is obtained in the conventional manner by means of a square-sectioned handle-bar 6 fitted in the handle 2 and locked therein by means of a cross-pin 7. Other types of couplings may be contemplated without departing from the basic principle of the present invention, Thus, notably, a handle-bar having a different cross-sectional configuration may be used.

The square-sectioned handle-bar 6 extends through a hole 8 formed for this purpose in plate 5. This plate is secured directly to the door 1, generally by means of screws (not shown).

According to an essential feature characterising the present invention a compensation means is incorporated in plate 5 for returning the handle 2 to its normal or inoperative position.

The compensation means relieves the lock and on the other hand permits of using a handle having a relatively heavy degree of unbalance without any risk of damaging the lock mechanism.

In fact, with the plate according to the present invention the unbalance due to relatively heavy asymmetric handles made of solid metal can be compensated. Thus, the torque generated by the handle weight is compensated completely in the lock by the presence of the plate of the present invention.

More particularly, the compensation means incorporated in the plate according to the present invention exerts an adjustable return or counterbalance torque on the handle. Under these conditions, according to circumstances, the compensation is adjusted to neutralize exactly the forces resulting from the presence of the handle, Thus, no additional effort is required for operating the door by rotating the handle.

According to the instant invention, the compensation means consists of a resilient member 10 housed in a recess formed in plate 5, said member 10 having one end anchored to the plate and the other end attached to the square-sectional handle-bar 6.

Figure 3:
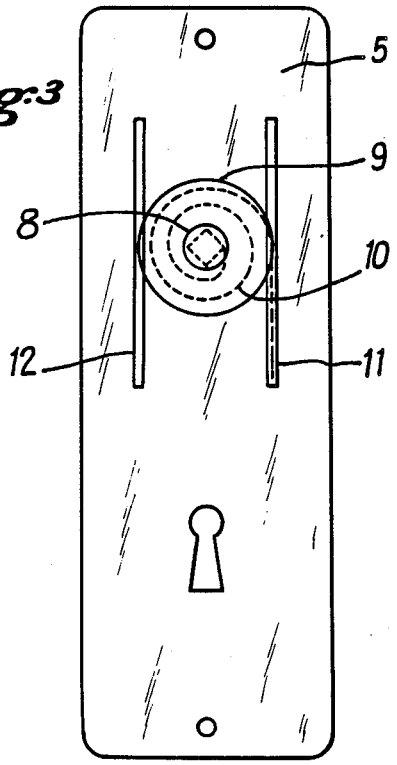
Figure 4:
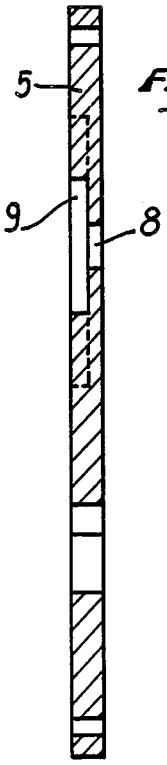

FIGS. 3 and 4 of the drawing illustrate the back side of the plate according to the present invention and a vertical axial section of the same plate, respectively. The recess 9 formed in the back face of plate 5 is adapted to receive the resilient member 10 shown in dash lines in FIG. 3. Preferably, this resilient member 10 consists of a spiral spring.

The central turn of spiral spring 10 has a square configuration so that it can be fitted on the square-sectioned handle-bar 6. This handle-bar 6 can be fitted in position by causing it to slide through the central turn of resilient member 10, whereafter the square-sectioned handle-bar 6 can be inserted into the lock 3. Due to its square-sectioned shape, the central turn is prevented from rotating relative to the handle-bar 6.

The recess 9 is open on the back side of plate 5. However, when the plate 5 is secured to the door 1, the recess 9 is closed by the door surface and the resilient member 10 is thus held against axial movement in said recess 9.

The outer end of spiral spring 10 is engaged and retained in a groove 11 formed in plate 5. Thus, the spring 10 is locked against rotation with respect to plate 5. Preferably, a plurality of such grooves 11 are formed around the periphery of recess 9 to permit the adjustment of the return torque exerted by the spring 10. According to requirements, the outer end of spring 10 is inserted in one or another of said grooves 11 so that after inserting the handle-bar 6 into the central turn of spring 10 and into the lock 3, the return torque be consistent with the weight of handle 2.

It is also contemplated to fit the spring 10 the opposite way in its recess 9 so as to provide a positive or negative rotational movement of handle-bar 6 accordingly as the plate 5 is fitted to a left-hand or to a right-hand door.

The dimensions of recess 9 should desiredly be slightly inferior to those of spiral spring 10 in the inoperative or unstressed position thereof. Thus, the spring 10 must be slightly compressed before fitting it into the recess 9, so that it will be retained by its expansion in the recess 9 and thus prevented from falling therefrom.

The recess 9 may advantageously have a circular cross-section and be provided with a pair of opposite tangent grooves 11, 12, as shown in FIG. 3.

The plate may be made from various materials, notably a machined noble metal.

From an aesthetic point of view, the present invention may be embodied in a relatively thin plate, so that the general appearance of the plate is not burdened by the presence of the compensation means. From the outside, the recess 9 is not visible and consequently the plate of the present invention has exactly the same appearance as most conventional door-lock and protection plates.

What is claimed is:

1. A door lock mounting plate for mounting on a door comprising:

a door plate fixed in the door and having an opening therethrough;

an inwardly facing recess formed in said door plate, said recess substantially concentric with said opening;

at least one inwardly facing groove formed in said door plate, said groove intersecting said recess, thereby forming an opening in a peripheral wall of said recess;

a square operating rod extending through said opening in said door plate;

a locking mechanism having a locking bolt operatively coupled to said square operating rod;

a handle for receiving and capturing one end of said square operating rod for rotation therewith, said handle capable of rotating said square rod from a first position wherein said locking mechanism is in a locking position to a second position wherein said locking mechanism is in a non-locking position, said handle being asymmetric with respect to an axis of rotation of said square operating rod received and captured therein, wherein the force of gravity acting on said asymmetrical handle produces a torque, tending to rotate said handle from said first position to said second position; and a compensating means for holding said handle in said first position against said torque tending to rotate said handle, said compensating means including a spiral spring mounted within said recess in said door plate, said spiral spring having a first end thereof operatively coupled to said square operating rod and a second end thereof being inserted in said opening in said peripheral wall of said recess and captured in said groove formed in said door plate.

2. The door lock mounting plate as set forth in claim 1 wherein said compensating means includes means for varying the tension in said spiral spring, thereby producing a variable force for holding said handle against said torque tending to rotate said handle from said position to said second position.

3. The door lock mounting plate as set forth in claim 2 wherein said means for varying said tension in said spring is at least one additional groove formed in said door plate and intersecting said recess said additional groove so positioned that the tension in said spiral spring is increased when said second end thereof is captured within said additional groove.

4. The door-lock mounting plate of claim 1, wherein said compensation means (10) are adapted to exert an adjustable return torque on said handle (2).

5. The door-lock mounting plate of claim 1, wherein the central turn of said spiral spring (10) has a square configuration.

6. The door-lock mounting plate of claim 1, wherein the outer end of said spiral spring is held against motion in a groove (11 or 12) formed in said plate (5).

7. The door-lock mounting plate of claim 6, wherein said plate (6) comprises a plurality of grooves (11, 12).

8. The door-lock mounting plate of claim 1, wherein the dimensions of said recess (9) formed in said plate (5) are inferior to those of said spiral spring (10) in its unstressed condition.

9. The door-lock mounting plate of claim 8, wherein said recess (9) is circular and comprises two tangent grooves (11, 12).

* * * * *